US007259378B2

(12) United States Patent
Madocks

(10) Patent No.: US 7,259,378 B2
(45) Date of Patent: Aug. 21, 2007

(54) CLOSED DRIFT ION SOURCE

(75) Inventor: John Madocks, Tucson, AZ (US)

(73) Assignee: Applied Process Technologies, Inc., Tucson, AZ (US)

( * ) Notice: Subject to any disclaimer, the term of this patent is extended or adjusted under 35 U.S.C. 154(b) by 0 days.

(21) Appl. No.: 11/177,984

(22) Filed: Jul. 8, 2005

(65) Prior Publication Data

US 2005/0247885 A1 Nov. 10, 2005

Related U.S. Application Data

(63) Continuation-in-part of application No. 10/411,024, filed on Apr. 10, 2003, now Pat. No. 6,919,672.

(51) Int. Cl.
*H01J 27/00* (2006.01)
*H05H 1/00* (2006.01)
*H05H 1/54* (2006.01)

(52) U.S. Cl. ..... 250/423 R; 250/424; 250/425; 313/153; 313/161; 313/162; 313/231.01; 313/231.31; 315/111.21; 315/111.41; 315/111.91

(58) Field of Classification Search ..... 250/423 R, 250/424
See application file for complete search history.

(56) References Cited

U.S. PATENT DOCUMENTS 4,277,304 A 7/1981 Horiike et al.
4,446,403 A * 5/1984 Cuomo et al. ..... 315/111.81
4,541,890 A * 9/1985 Cuomo et al. ..... 156/345.39
4,774,437 A * 9/1988 Helmer et al. ..... 315/111.81
5,763,989 A 6/1998 Kaufman
5,892,329 A 4/1999 Arkhipov et al.
5,945,781 A 8/1999 Valentian
6,215,124 B1 4/2001 King
6,911,779 B2 * 6/2005 Madocks ..... 315/111.21
6,919,672 B2 * 7/2005 Madocks ..... 313/359.1
7,023,128 B2 * 4/2006 Madocks ..... 313/359.1
7,038,389 B2 * 5/2006 Madocks ..... 315/111.21
2002/0145389 A1 * 10/2002 Bugrova et al. ..... 315/111.81
2003/0209198 A1 * 11/2003 Shabalin et al. ..... 118/723 R
2003/0230961 A1 * 12/2003 Madocks ..... 313/359.1

(Continued)

OTHER PUBLICATIONS

Shabalin et al., Industrial Ion Sources and Their Application for DLC Coating, 1999, pp. 1-6.

(Continued)

*Primary Examiner*—Nikita Wells
*Assistant Examiner*—Bernard Souw
(74) *Attorney, Agent, or Firm*—Lawrence R. Oremland, P.C.

(57) ABSTRACT

A closed drift ion source which includes a channel having an open end, a closed end, and an input port for an ionizable gas. A first magnetic pole is disposed on the open end of the channel and extends therefrom in a first direction. A second magnetic pole disposed on the open end of the channel and extends therefrom in a second direction, where the first direction is opposite to the second direction. The distal ends of the first magnetic pole and the second magnetic pole define a gap comprising the opening in the first end. An anode is disposed within the channel. A primary magnetic field line is disposed between the first magnetic pole and the second magnetic pole, where that primary magnetic field line has a mirror field greater than 2.

10 Claims, 13 Drawing Sheets

U.S. PATENT DOCUMENTS

2004/0016640 A1* 1/2004 Veerasamy et al. .... 204/298.19
2004/0135485 A1* 7/2004 Madocks ..... 313/359.1
2004/0149574 A1* 8/2004 Madocks ..... 204/298.16
2004/0151595 A1* 8/2004 Quon et al. ..... 417/49
2004/0155592 A1* 8/2004 Madocks ..... 315/111.21
2004/0217713 A1* 11/2004 Madocks ..... 315/111.41
2005/0035731 A1* 2/2005 Secheresse et al. ..... 315/500
2005/0098118 A1* 5/2005 Amann et al. ..... 118/723 CB
2005/0247885 A1* 11/2005 Madocks ..... 250/423 R

OTHER PUBLICATIONS

Keem, "High Current Density Anode Layer Ion Sources", 2001, pp. 1-6.
Advanced Energy Industries, Inc., "Round and Linear Ion Beam Sources", 2000.
Kaufman et al, "End-Hall Ion Source", Jul./Aug. 1987, pp. 2081-2084.

* cited by examiner

CLOSED DRIFT ION SOURCE

CROSS REFERENCE TO RELATED CASES

This application is a Continuation-In-Part application claiming priority from a U.S. application having Ser. No. 10/411,024, filed Apr. 10, 2003, now U.S. Pat. No. 6,919,672.

FIELD OF THE INVENTION

This invention relates to closed drift ion sources and to closed drift type ion thrusters. More particularly, it includes embodiments that extend the life and efficiency of these devices.

BACKGROUND OF THE INVENTION

Closed drift ion sources have been known since Russian ion thrusters for satellite propulsion were reported in the 1960's. These prior art devices suffer from problems of sputter erosion of the closed drift side walls, loss of energetic electrons to the side walls, and poor beam collimation out of the source.

Side wall erosion has deleterious effects on ion source performance including:

- The source wall inserts, magnetic poles, or other plasma exposed surfaces must be routinely replaced. Where replacement is not possible in space thruster applications, wall erosion is eventually catastrophic. In these applications, thrusters are rated in thousands of hours of life with some 2,000–10,000 hours being the published life expectancies.
- Ion sputtering of the side walls contaminates industrial ion source processes with the sputtered atoms. In many applications, this precludes these ion sources as potential process tools.
- Sputtering of the side walls raises the source wall temperature. This can be a severe problem in space based applications where heat must be dissipated by radiation. The high temperatures experienced by the side walls requires special, expensive materials.
- Ions striking the side walls do not exit the source, reducing source efficiency. (Efficiency is the ion current and energy relative to the power supply discharge current and voltage.)
- In ion sources operated in the diffuse mode, erosion is particularly problematic if not ruinous. In the diffuse mode, the source is operated at sufficiently high pressure and power to create a neutral, conductive plasma in the gap between the poles. Operating in this mode, the plasma density is dramatically increased, and the electric fields change significantly, increasing ion bombardment of the pole pieces or side walls.

Other problems generally recognized with prior art ion sources include:

- Loss of high energy electrons to the side walls. This especially affects extended acceleration channel type ion sources. Side wall losses of electrons capable of ionizing the propellant gas results in loss of efficiency and side wall heating
- Beam spreading outside the source. Here, the ion beam produced leaves the source in a spread cosine distribution rather than the preferred collimated output.

There are two basic types of closed drift ion sources for which many variations have been offered. The two types are anode layer and extended acceleration channel. Prior art examples for each type of source are described below.

FIG. 1 is a section view of prior art linear anode layer type ion source 100. Additional description of this prior art device can be found in Capps, Nathan, et al., Advanced Energy Industries, Inc. *Application note: Ion Source Applications: Si Doped DLC,* and in Advanced Energy Industries, Inc. *Application note: Industrial ion sources and their application for DLC coating,* which are hereby incorporated by reference.

Such a prior art source 100 can either be annular or stretched out to lengths beyond three meters, the confined Hall current design enables extendibility similar to a planar magnetron. FIG. 1 shows the magnetic field lines as calculated and mapped by a two-dimensional magnetic field software program. The field in the gap 120 is created by back shunt 110, permanent magnet 130, and pole pieces 140 and 150. Electrically, poles 140, 150 and shunt 110 are connected to ground, and anode 102 is connected to the positive terminal of a high voltage power supply.

As those skilled in the art will appreciate, the anode 102 in a closed drift ion source is disposed a distance from the gap 120 between the poles 140 and 150, where that distance exceeds the Larmor radius of the captured electrons. As those skilled in the art will further appreciate, the width of the gap 120 is adjusted to maintain a magnetic field of sufficient strength to magnetize electrons and to allow a plasma to exist therein.

Referring to FIGS. 1 and 1A, in prior art device 100, the half bevel shaped poles 140 and 150 produce a magnetic fields with the strongest magnetic field line, described herein as the "primary field line," emanating from the flat, gap facing pole surfaces 142 and 152. The magnetic configuration and pole shapes of this prior art device, calculated using a Ceramic 8 ferrite type magnet 130, results in a primary field line 170 having a magnetic field strength of 682 Gauss at first end 172 on surface 152, 542 Gauss at second end 176 on surface 142 of outer pole 140, and a minimum strength of 445 Gauss at location 174. As those skilled in the art will appreciate, use of other magnetic materials will change the relative strengths of the field lines but will not substantially change the relative location of the primary line or ratio between surface and gap fields.

By "primary field line," Applicant means the field line having the least curvature and the strongest field strength in the gap. As the bloom of the field in the gap is viewed, the primary field line is the centerline of the bloom. Field lines to both sides of the primary field line are concave, i.e. curved, and face this field line.

As the magnetic field lines leave the high permeability poles 140 and 150, enter the "air" gap 120, and travel toward the center of the gap, the magnetic field strength lessens. Visually, this is seen as field lines spreading out in the gap. The result of this effect is a magnetic mirror. By "magnetic mirror," Applicant means the "reflection" of electrons as an electron moves from a region of weaker field to a stronger field.

Applicant has discovered that the mirror ratio is an important aspect of closed drift ion source magnetic design. By "mirror ratio," Applicant means the ratio of the strong field strength at an end of the field line to the minimum field strength along that field line. For example, in source 100, using calculated field strengths of the primary field line 170 from first end 176 to location 174, the magnetic mirror ratio is 1.22. From second end 172 to location 174 the magnetic mirror ratio is 1.53. Therefore, the minimum mirror ratio for source 100 is 1.22.

In addition, the ratio of the magnetic strengths at the end of the primary field line indicates whether that primary field line is substantially symmetric or asymmetric. By "substantially symmetric," Applicant means an end-to-end ratio of magnetic strengths of between about 0.94 to about 1.06. For prior art device 100, the ratio of the magnetic field strengths at locations 172 and 176 is about 1.26 indicating an asymmetric mirror field existing between the pole portions.

Applicant has found that a minimum mirror ratio greater than 2 in combination with an end to end ratio of between 0.94 and 1.06 to be optimal. The magnetic pole design of device 100, however, produces weak magnetic mirror fields in gap 120. The result is that when a plasma is disposed in gap area 120, electrons are not strongly focused into the center of the gap. This results in substantial sputtering of the poles 140 and 150 and lower source efficiency.

Pole sputtering is exaggerated when the source is operated in the diffuse mode. This mode is entered when the plasma is dense enough to become electrically neutral. When this occurs, the electric fields change from a gradient field from the cathode poles 140 and 150 in gap 120 to anode 102 to a field dropping from the cathode poles across the dark space to the plasma and from the plasma to the anode. The diffuse mode is entered when a combination of higher process gas pressure and high discharge power produces a bright glow in the gap region. The diffuse mode is visually quite different from the collimated mode making the modes easy to distinguish by eye. In the diffuse mode, sputtering of the poles is increased due to the higher concentration of ions in the gap and the large voltage drop between the plasma and cathode pole surfaces.

Sputtering of the poles contaminates the substrate with sputtered material, causes wear of the cathode poles requiring their regular replacement, adds appreciably to the heat load the source must handle, and makes the source less energy efficient.

In contrast to this prior art device, Applicant's device creates a strong magnetic mirror field in the gap along the primary field line. Such a strong magnetic mirror has dramatic benefits for source operation. Without this focusing mirror field, not only are the poles eroded more rapidly, but the lack of the mirror field focusing effect causes the ion source to produce a broader, less collimated beam.

In addition, prior art device 100 includes a single central magnet. The resulting magnetic field is not symmetrical across gap 120 with one magnetic mirror being stronger than the other. As will be described below, symmetrical magnetic mirrors can be created with strong mirror fields along the central field line to focus the plasma in the center of the gap and optimize magnetic mirror repulsion from the poles.

FIGS. 2 and 2A show a section view of prior art anode layer ion source 200. Device 200 includes shunt 210, magnet 230, poles 240 and 250, and anode 202. An analysis of this pole design shows that the primary field line emanates from the flat faces 242 and 252 of poles 240 and 250, respectively, rather than from the pointed portions 241/251.

Magnetic field line 270 comprises the primary field line in this prior art embodiment. Field line 270 has a magnetic field strength of 683 Gauss at first end 272 on surface 252, 580 Gauss at location 276 on second end 242, and 373 Gauss at location 274 on field line 270. Location 274 comprises the portion of field line 270 having the minimum magnetic field strength. Dividing the magnetic field strength at end 272 by the magnetic field strength at location 274 gives a mirror ratio of 1.83. The magnetic mirror formed between 276 and 274 is 1.55. Therefore the minimum mirror ratio is 1.55. Dividing the strength at end 272 by the strength at end 276 gives a ratio of about 1.17 thereby indicating an asymmetric mirror field existing between the pole elements.

FIGS. 3 and 3A show prior art anode layer source 300 as depicted in FIG. 3 in the publication 'High Current Density Anode Layer Ion Sources' by J. Keem, Society of Vacuum Coaters 44$^{th}$ Annual Technical Conference Proceedings. Device 300 includes permanent magnets 331 and 332, in combination with pole portions 340 and 350, and anode 302. Field line 370 comprises the primary field line produced by device 300. Field line 370 has a magnetic field strength of 1013 Gauss at first end 372 on surface 352, 954 Gauss at second end 376 on surface 362, and a minimum strength of 565 Gauss at location 374 on field line 370. Therefore, the minimum mirror ratio for the primary field line for device 300 is 1.69.

FIG. 4A shows a second type of ion source sometimes referred to as an extended acceleration channel type. Extended acceleration channel type ion source 400 is typical of prior art ion thruster propulsion devices. U.S. Pat. No. 5,892,329, in the name of Arkhipov et al., and U.S. Pat. No. 5,945,781, in the name of Valentian, describe such sources. Extended acceleration channel sources are commonly used in space thruster applications but can be adapted for industrial use also.

FIG. 4A shows the magnetic field lines produced by extended acceleration channel source 400. In this source, magnetic poles 440 and 450 are electrically floating. An electron source 480 serves as the cathode with anode 402 located inside ceramic isolator 490. Anode 402 is positioned at the bottom of channel 422 such that electrons must pass through magnetic fields crossing gap 420 to reach anode 402.

It is known that the ceramic side walls of an extended acceleration channel source, such as source 400, tend to be eroded by ion bombardment. Because prior art device 400 separates the magnetic poles 440 and 450 from the channel with the insulating ceramic 490, and because device 400 does not optimize the pole shapes, a strong magnetic focusing mirror radial field is not created in the channel.

Prior art device 400 produces a primary field line 470 having a magnetic field strength of 1011 Gauss at 472 on the inner surface of insulator 490, 883 Gauss at 476 on inner surface of insulator 490, and a minimum magnetic field strength of 687 Gauss at location 474. This being the case, the minimum magnetic mirror ratio along the primary field line for device 400 is 1.29. The result of a weak mirror field is:

- Electrons, accelerated into the magnetic field in the channel by the electric field, are trapped by the magnetic field. Without a containing radial magnetic mirror field, these energetic electrons move along the field lines and can be absorbed by the side walls. Loss of high energy electrons to the walls lowers source ionization efficiency and heats the side walls.
- Ambipolar diffusion causes the side walls to be charged negatively, and ions are attracted to the side walls.
- The lack of radial electron focusing results in electron distribution across the full channel width. Ions then are created across the full width producing a wider, less collimated beam and added likelihood of ions hitting the side wall.
- Only the ions created in the center of the channel experience the electric field pushing them perpendicularly out of the source. Without strong electron focusing, fewer are created in the center.

FIG. 4B is a section view of ion source 900 described in U.S. Pat. No. 5,763,989 in the name of Kaufmann. Ion source 900 includes poles 940 and 950, in combination with anode 902, in further combination with a magnetic screen shunt similar to that taught in U.S. Pat. No. 5,892,329 in the name of Arkhipov, except the Kaufman shunt is arranged to allow a single permanent magnet to be used. This shunt technique produces a limited focusing effect in the acceleration channel that potentially results in reduced wall losses and less wall erosion.

While producing a mirror field at one side of the gap, the flat pole faces produce a weak mirror field in the center of the gap. Device 900 produces a primary field line having a magnetic strength of 600 Gauss at first end 972, 550 Gauss at second end 976, and a minimum magnetic field strength of 400 Gauss at location 974. Therefore, the minimum mirror ratio for device 900 along the central primary field line 970 is 1.4.

U.S. Pat. No. 4,277,304 in the name of Horiike et al. teaches an ion source and ion etching process. Horiike et al. teach an arrangement for what is termed a grid-less ion source. The ion beam is created by two cathode surfaces with a magnetic field passing between the two surfaces The cathode surfaces and magnetic field are shaped into a racetrack to provide an endless Hall current confinement zone. An anode is disposed on one side of the racetrack magnetic field loop. This arrangement produces an ejection of ions from the side opposite the anode. Other prior art devices implemented electromagnets to create the magnetic field between the cathode surfaces. Horiike et al. teach the use of permanent magnets and a flat facing pole shape.

U.S. Pat. No. 5,359,258 to Arkhipov et al. teaches a closed drift ion accelerator wherein side wall erosion is reportedly lessened by lowering the amount of magnetic field in the acceleration channel by shunting the field with permeable screens. The idea is to move the containment of electrons from the central channel area out closer to the opening. The screens also shape the magnetic field to provide an amount of focusing of the plasma that helps to reduce side wall erosion. According to Arkhipov et al., the focusing effect allows making the channel walls thicker so the source lasts longer too.

Arkhipov et al. nowhere teaches shaping the magnetic poles to produce a strong radial mirror magnetic field in the gap and, more particularly, to produce that strong mirror field along the primary field line. As shown in FIG. 4A, when the poles are separated from the channel by an insulator, the mirror ratio along the primary field line is less than 2.

U.S. Pat. No. 5,838,120 in the name of Semenkin et al. describes an anode layer source comprising a magnetically permeable anode to shape the magnetic field. The use of a magnetic shunt to remove radial, poorly mirrored magnetic field from the central channel, and moving the anode closer to the exit end, may reduce wall erosion. This prior art device, however, only provides marginal improvements. Semenkin et al. nowhere teaches shaping of the magnetic field to produce a strong, focusing mirror field along the primary field line. The device taught by Semenkin et al. results in electrons that are largely free to move along magnetic field lines and, in this case, recombine at the walls.

U.S. Pat. No. 6,215,124 in the name of King discloses a multistage ion accelerator with closed electron drift. In this device, the life and efficiency of the thruster is improved by shunting the magnetic field away from the central accelerator channel region and moving the $B_{max}$ field line toward the open end. When this is done, the region of wall erosion moves farther toward the opening, extending the life of the thruster. While use of thin pole pieces could generate a mirror field of some strength, the poles are distanced from the channel by inserts. The result is a weak magnetic mirror field at the exit end with the accompanying negative results.

SUMMARY OF THE INVENTION

Applicant's invention includes a closed drift ion source for generating an accelerated ion beam having an annular or otherwise closed loop discharge region into which ionizable gas is introduced with an anode located at one longitudinal end of said region, the other end open to allow ion flow out of the discharge region. A first magnetic pole is located radially inward from the discharge region. A second magnetic pole is located radially outward from the region. These poles create a strong magnetic mirror field in the discharge region with the mirror field approximately centered on the primary magnetic field line between the said two poles and where the magnetic mirror has a minimum mirror ratio greater than 2.

Applicant's invention further includes a closed drift ion source for generating an accelerated ion beam having an annular or otherwise closed loop discharge region into which ionizable gas is introduced with an anode located at one longitudinal end of the region and the other end open to allow ion flow out of the discharge region. A first magnetic pole is located radially inward from said region, a second magnetic pole is located radially outward of said region and the poles are shaped to a point including beveled, non-orthogonal surfaces on both the internal and external pole surfaces.

Applicant's invention further includes a method to focus a plasma. Applicant's method provides an ionizable gas and introduces that ionizable gas into Applicant's closed drift ion source comprising a first magnetic pole and a second magnetic pole separated by a gap. Applicant's method produces a primary magnetic field line disposed between the first magnetic pole and the second magnetic pole, wherein that primary magnetic field line has a mirror field greater than 2. Applicant's method forms in the gap a plasma from the ionizable gas.

DETAILED DESCRIPTION OF THE PREFERRED EMBODIMENTS

While the prior art has recognized the problems of existing ion source technology, Applicant's improvements described herein address these prior art problems. Referring to the illustrations, like numerals correspond to like parts depicted in the figures. The invention will be described as embodied various ion source devices to contain, focus, and direct a plasma formed from one or more ionizable gases. The introduction of such one or more ionizable gases into an ion source device, and the formation and ignition of such a plasma is known to one of ordinary skill in the art. This being the case, for purposes of simplicity FIGS. 5, 6, 7, 8, and 9, do not show an input for one or more ionizable gases or a plasma formed therefrom.

Figure 5:
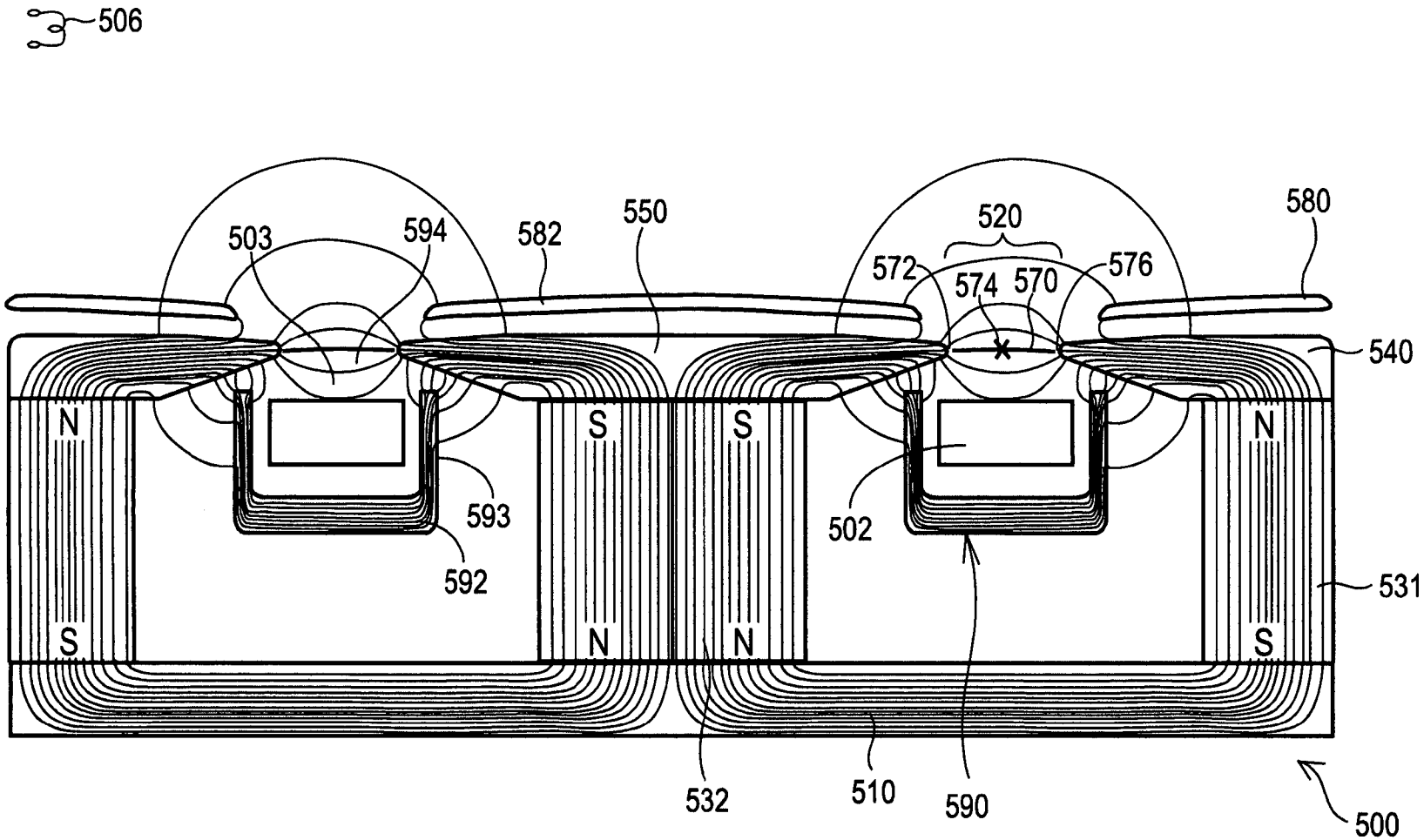
FIG. 5 is a section view of one embodiment of Applicant's ion source.

FIG. 5 is a section view of a closed drift ion source showing the magnetic fields of the preferred embodiment. The magnetic field across gap 520 is created by magnet shunt 510, magnets 531 and 532, pole pieces 540 and 550 and magnetic screen 590. In this source, magnet shunt 510, poles 540 and 550 and screen 590 are connected to the cathode. Anode 502 is inside the body of the source. The anode is positioned to cut electron trapping magnetic field lines. This arrangement is termed an anode layer ion source as are the sources shown in FIGS. 1, 1A, 2, 2A, 3, 3A, and 4B.

This preferred embodiment uses a single, strong, symmetrical magnetic mirror field in gap 520 between poles 540 and 550. In this case, the strong mirror field is created by the pointed shape of magnetic poles 540 and 550 and by shunts 580, 582 and 590. The pointed shape concentrates the magnetic field from magnets 531 and 532 to create a large magnetic mirror field across the gap 520. The shunts 580, 582 and 590 tend to accentuate the mirror field while also pulling magnetic field away to eliminate low mirror field lines. The result is a single, strong magnetic mirror field across gap 520.

An analysis of the field strengths in this configuration show a primary field line 570 having a magnetic field strength of 5141 Gauss at end 572 disposed on central pole 550 and 4848 Gauss on second end 576 disposed on outer pole 560. In the center of the gap 520 at position 574, the primary field line has a minimum magnetic field strength of 1487 Gauss. This results in a mirror field ratio from 572 to 574 of 3.5 and a ratio from 576 to 574 of 3.3. Therefore the minimum magnetic mirror ratio for device 500 is in excess of 3:1. (These field strengths were obtained using Ceramic 8 magnets and carbon steel poles and shunt. The materials and absolute magnitudes are not critical. Rather, it is the relative magnitudes from the pole surface to the gap center along the central field line that is important. For instance, rare earth magnets could be used along with vanadium permador pole material to increase the magnitudes.) The strong mirror field produces a focusing effect on electrons trapped in the field. Instead of ranging between the containing pole surfaces, they are concentrated in the central gap region.

Not only is a strong mirror field important, but reducing regions of weak mirror fields where ionization occurs is also helpful. This is accomplished using two techniques in FIG. 5. First, magnetic shunt 590 pulls magnetic field from pole regions of weaker magnetic field, and, second, anode 502 is positioned to remove electrons from weaker magnetic field regions. Both these methods are effective in preventing high energy electrons from being trapped in regions of weak magnetic mirror fields. Magnetic shunts 580 and 582 have a reduced roll in accomplishing this. Because less electric field penetrates through the gap 520, high energy electrons are less prevalent outside the source and less ionization occurs. However, if the gap width is increased, more E field moves outside the gap, and eliminating weak mirror fields outside the source becomes more important.

Note also that the magnet design and pole structure creates a relatively symmetrical magnetic mirror field between the two poles. As electrons gyrate along field lines, they are trapped into the center by both poles. In several prior art sources, a single magnet is used in the center region. As was shown in the analysis of these sources, this produces an unsymmetrical magnetic field in the gap. If a strong magnetic mirror on one pole is not matched along that field line by a similarly strong mirror field at the opposed pole, the mirror field is wasted. Electrons will be pushed away from the mirror pole and will escape to the wall of the poor mirror pole. Therefore, symmetrical strong mirror magnetic fields opposed to each other along the same primary field line is an important aspect of an improved ion source. Analyzing the magnetic fields in FIG. 5, the ratio of magnetic strengths at the poles, i.e. at ends 572 and 574, is 1.06 showing a substantially symmetrical mirror field disposed within gap 520.

Creating a single strong mirror field in the containment region and minimizing weak mirror fields has several benefits:

The high energy electrons are confined radially by the mirror field. Instead of only the longitudinal v X B confinement, radial confinement limits electron "conductance" to further compact and condense the electrons into the center of the gap. This produces a higher electron "pressure" in the central region improving efficiency of the source.

More ionization occurs in the center of the gap away from the pole surfaces. In this central region, the electric field tends to push the ions out of the source rather than toward the cathode poles. This further improves efficiency and reduces pole erosion.

In sources with insulating poles and weak mirror magnetic fields, a significant portion of electrons are lost to the walls without accomplishing ionization. With a strong mirror field, many electrons are reflected back as they approach the side wall. The stronger the mirror field, the larger the percentage of reflected electrons and the higher the source efficiency.

By minimizing regions of weak mirror field, pole erosion is reduced and source efficiency is increased. In regions of weak mirror field, electrons can more freely range between the containing surfaces. As ions are produced from electron collisions wherever high energy electrons are, ions are created more evenly throughout the physical containment region. When ions are created close to a side wall, they are more likely to "see" the side wall and be accelerated to it. Ion bombardment of the side walls causes side wall erosion and reduces source efficiency.

A strong mirror field in the gap also reduces source heating. Source heating is caused by both high energy electron wall losses and ion wall bombardment. The preferred embodiment reduces both of these.

By focusing electrons in the center of the gap and concentrating ionization there, more ions are ejected perpendicular to the racetrack closed loop. This results in a more efficient ion thruster or industrial ion source.

The preferred embodiment is also effective when these sources are operated in the plasma or diffuse mode. In the standard "ion beam" or collimated mode, the electric fields are not altered by a conductive plasma in the gap. This mode is maintained by operating at low pressures (~less than 1 mTorr) or at lower powers. In the diffuse mode, sufficient plasma develops in the gap to produce a conductive plasma region and change the electric fields. This mode is often avoided because the earlier stated problems of source heating and side wall erosion are exacerbated. Focusing the plasma into the center of a single, strong mirror field helps to reduce pole erosion and increase efficiency in the diffuse mode. As in the collimated mode, the mirror field tends to confine electrons into the center of the gap. This confines the plasma toward the center producing the benefits as stated above.

Ions can also be affected by the preferred embodiment. When magnetic field strengths approach or exceed 1000 G, ions in the gap can become magnetized. That is, the radius of gyration of the ions is less than the size of the magnetic field. When magnetized, ions are also affected by a strong magnetic mirror field in the gap and, like electrons, are focused into the center of the gap.

Other important aspects of the preferred embodiment are:

The poles are shaped to focus the magnetic field to create a strong mirror at the pole. By shaping the high permeability poles, the magnetic field emanating from the pole can be made significantly stronger. This is an important design aspect that has been overlooked by prior art. As shown in FIG. 5, as the poles neck down toward the gap, the magnetic field tends to try to stay in the pole material. This progressively compresses the field and results in a strong mirror field at the end of the pole. Steel is used in the preferred embodiments shown because it has a relatively high permeability and high saturation level; it is inexpensive and easy to machine. More esoteric materials are available that are more permeable and saturate at higher levels than steels. Other magnet materials such as rare earth magnets, soft ferrite magnets or electromagnets can also be implemented. The material selection and choice of magnets will vary with the application, and the appropriate design will be evident to one skilled in the art.

Note: While water cooling is not shown in the figures, it is often required in industrial applications where high powers and continuous usage is the norm. One option is to gun drill the poles and directly flow water through them. In this case, a magnetic stainless steel such as grade 416 is a good choice. It does not corrode easily, is machinable, and has decent magnetic properties.

The regions 572 and 576 on the poles can be either sharp or rounded. A 0.03 inch radius is given to the poles in FIG. 5. While sharper points can provide higher surface magnetic fields and a larger central field mirror effect, the mirror effect is concentrated in a smaller region, enlarging the weaker mirror regions. Using a radius as shown produces a larger strong mirror field region. Also, magnetic saturation tends to lower the local sharp point effect reducing the effectiveness of sharply pointed poles.

The poles can take on a variety of shapes while still being in accordance with the preferred embodiment. For instance, the poles can be made from thin sheet metal or a combination of several metal sheets or plates.

Figure 6:
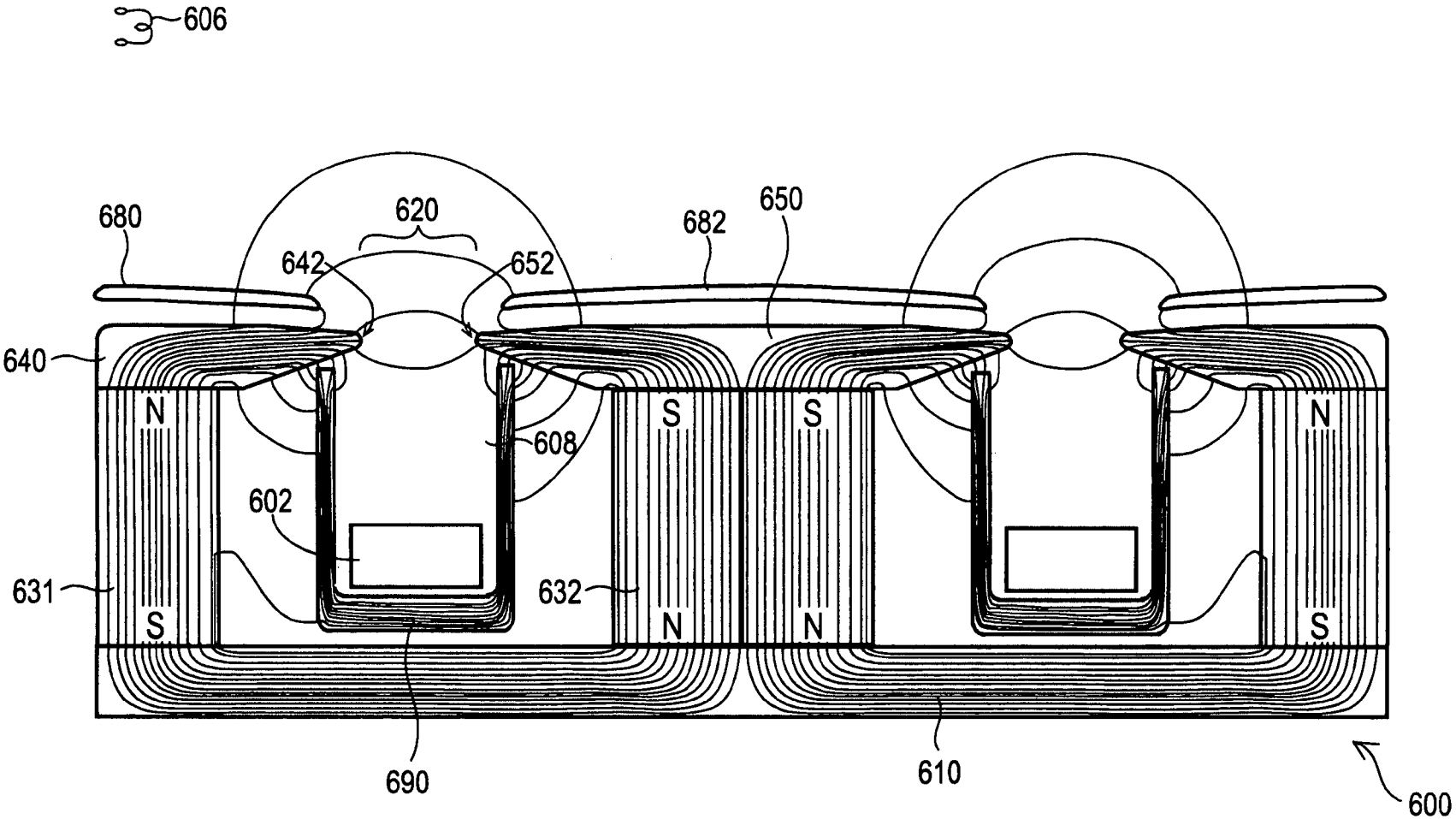
FIG. 6 shows a section view of one embodiment of Applicant's ion source implementing an extended acceleration channel.

FIG. 6 shows a section view of an extended acceleration channel ion source of a preferred embodiment. Again, a strong magnetic mirror field is produced in gap region 620 by magnetic shunt 610, magnets 631 and 632 and poles 640 and 650. Magnetic shunt 690 is extended downward to allow anode 602 to be placed further from the magnetic field. In this source, the magnetic poles are not connected to the source power supply. (They can be connected to a second bias supply if desired.) Electrons are supplied by source 606. External magnetic shunts 680 and 682 reduce the external magnetic fields and help to concentrate the mirror field in the gap 620. In this source, electrons leaving the emission source 606 are trapped in the gap by the magnetic field. By eliminating regions of weaker mirror fields, the circuit resistance is concentrated in the strong mirror region, and the voltage drop between the cathode 606 and anode 602 takes place wholly in this region. Again, high energy electrons are "focused" both longitudinally and radially into the center of the gap 620, and a greater majority of the ions are produced in the center. All the benefits stated above are achieved with this source.

Figure 7:
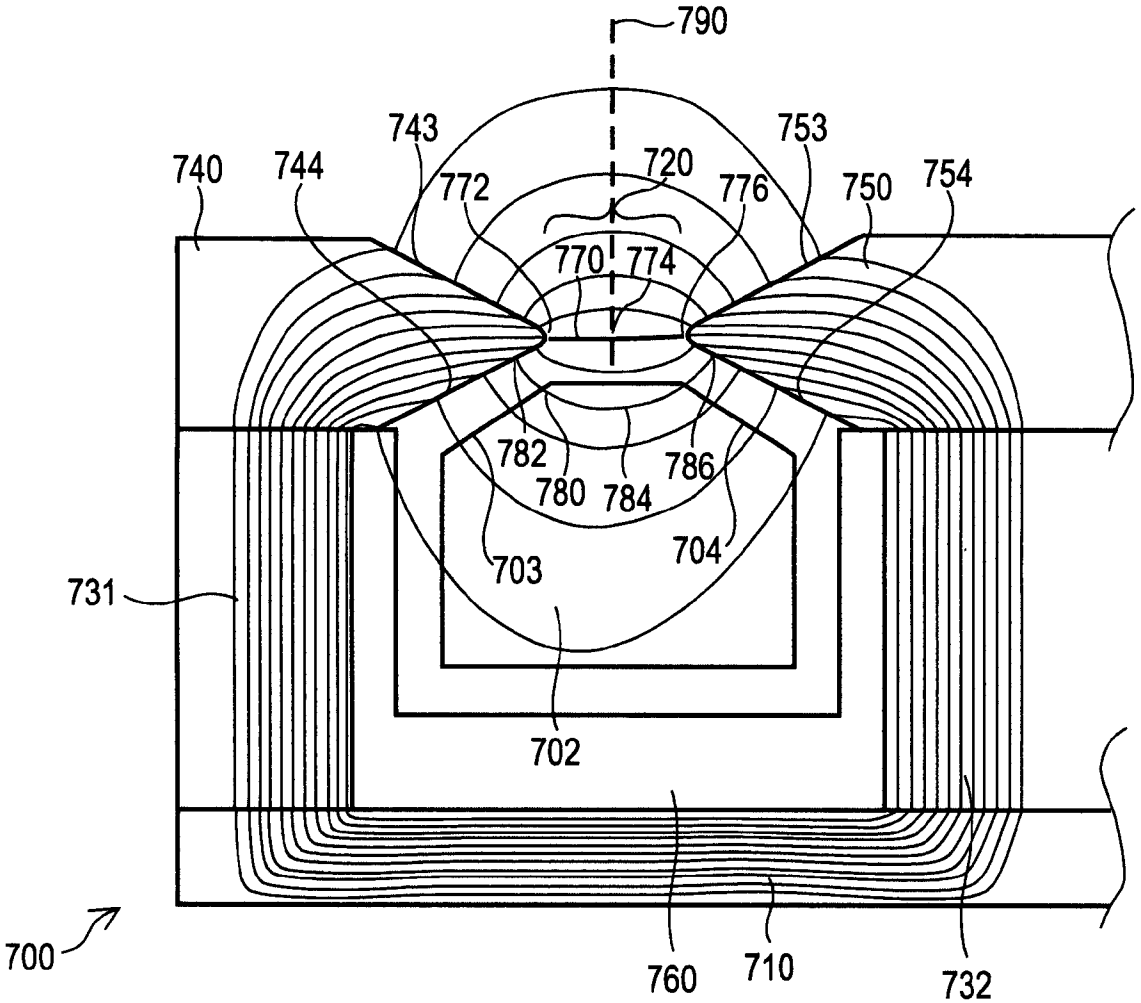
FIG. 7 shows a section view of one half of a symmetrical anode layer type source implementing the Applicant's inventive method.

FIG. 7 shows a section view of one half of a symmetrical anode layer type source implementing a preferred embodiment. Magnetic field strengths at different locations are indicated to show that the magnetic field is concentrated effectively at the pointed pole regions 772 and 776 producing a minimum mirror field in the gap 720 in excess of 2:1. The values also show that further away from the pole points, the magnetic field strength diminishes quickly, and the mirror field becomes weaker. The magnetic field in gap 720 of source 700 is produced by steel back shunt 710, ceramic magnets 731 and 732 and steel poles 740 and 750. At pole end 742 the magnetic field strength is 4320 gauss. At pole end 752 the field is 4530 gauss. In the center 774 of gap 720 along primary field line 770 the field is 1420 gauss. This produces a minimum magnetic mirror of 3:1. The mirror field of source 700 is also relatively symmetrical with a symmetry ratio between poles 752 and 742 of 1.05. Away from the rounded pole end 742 on beveled surface 744 the magnetic field strength at 782 is 1320 gauss. Across the gap on field line 780 the field at 786 is 1520 gauss. At the center 784 of line 780 the field strength is 1040 gauss. Therefore, away from the pointed pole the mirror magnetic field is weaker, with a minimum ratio of 1.3:1. Rather than eliminating the weaker field regions with magnetic shunts as in sources 500 and 600, in ion source 700 the anode 702 is placed to cut these weaker mirror field lines. In this position, the anode serves to collect electrons and eliminate ionization in the region of weak mirror field. In this source the magnetic poles 740 and 750 are connected to the cathode electrode. Non-magnetic housing 760 is also connected to the cathode. Housing 760 serves to present anode 702 with a uniform dark space. Insulators supporting anode 702 are not shown and are well know in the art. In this arrangement, the electric field is largely contained within the body of the source so the magnetic field lines external to the gap 720 have less affect on operation.

Figure 1:
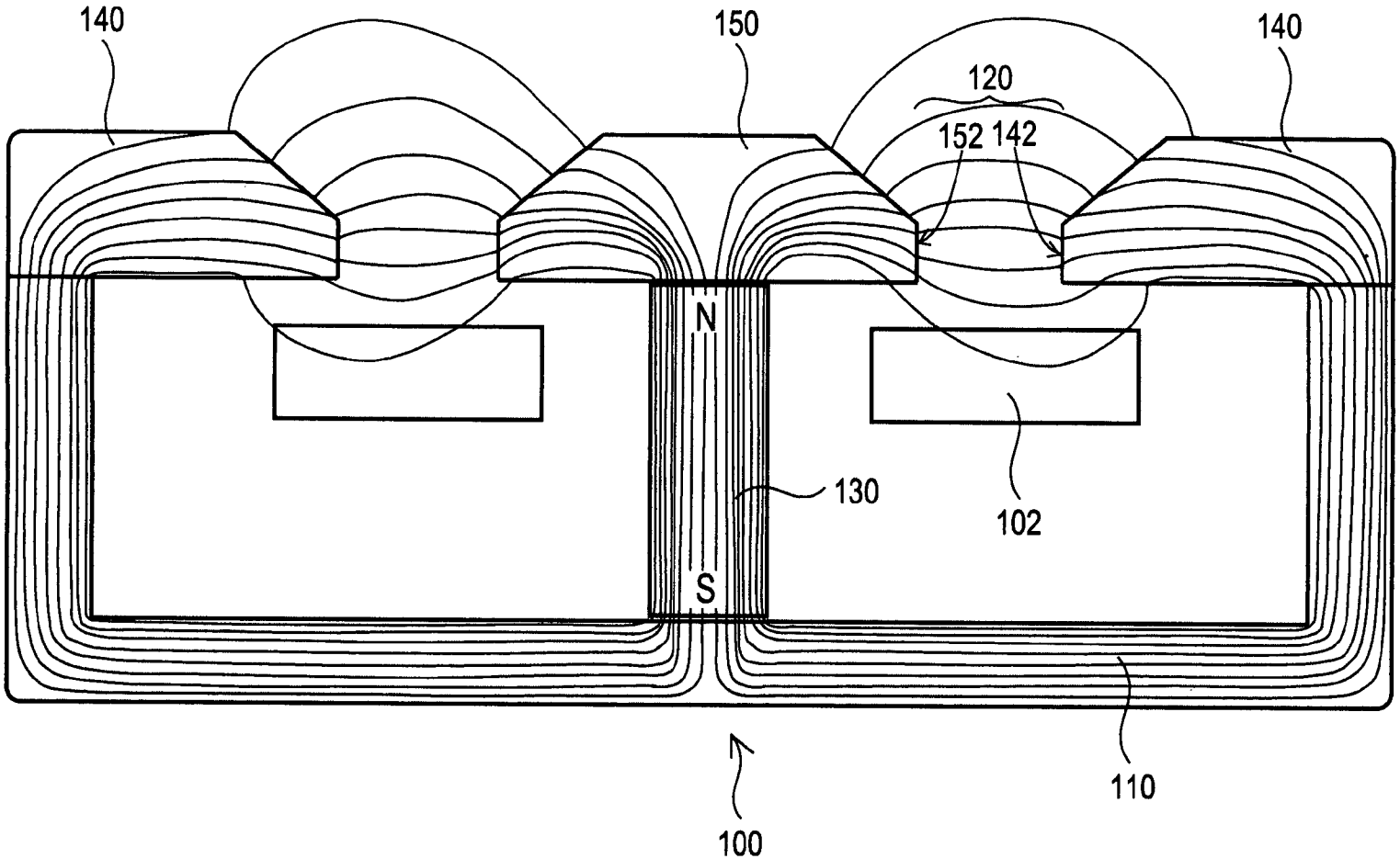
FIG. 1 PRIOR ART
FIG. 1 is a section view of a prior art anode layer ion source device.
Figure 1A:
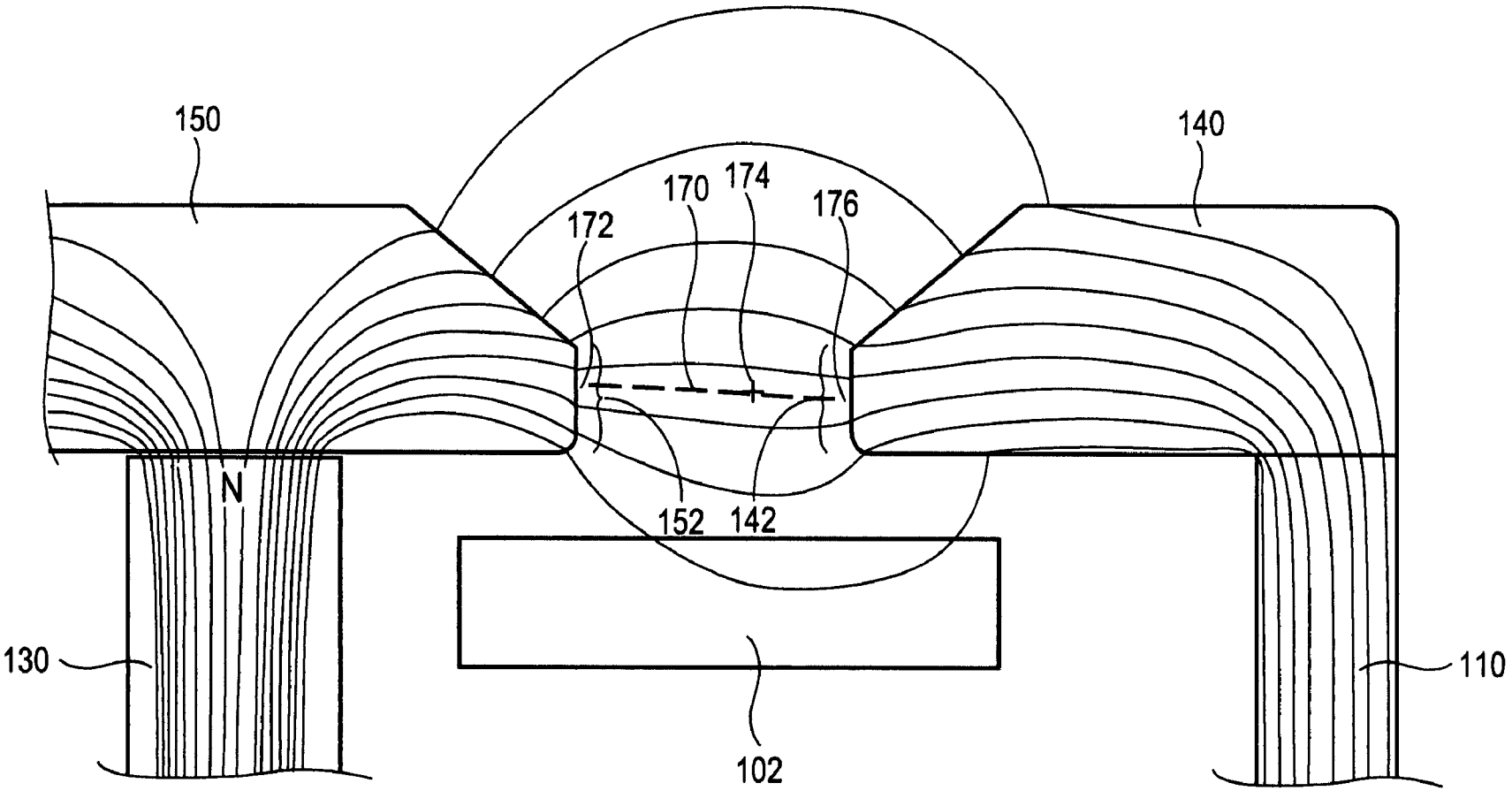
FIG. 1A PRIOR ART
FIG. 1A is a detail view of one gap region of the device of FIG. 1.
Figure 2:
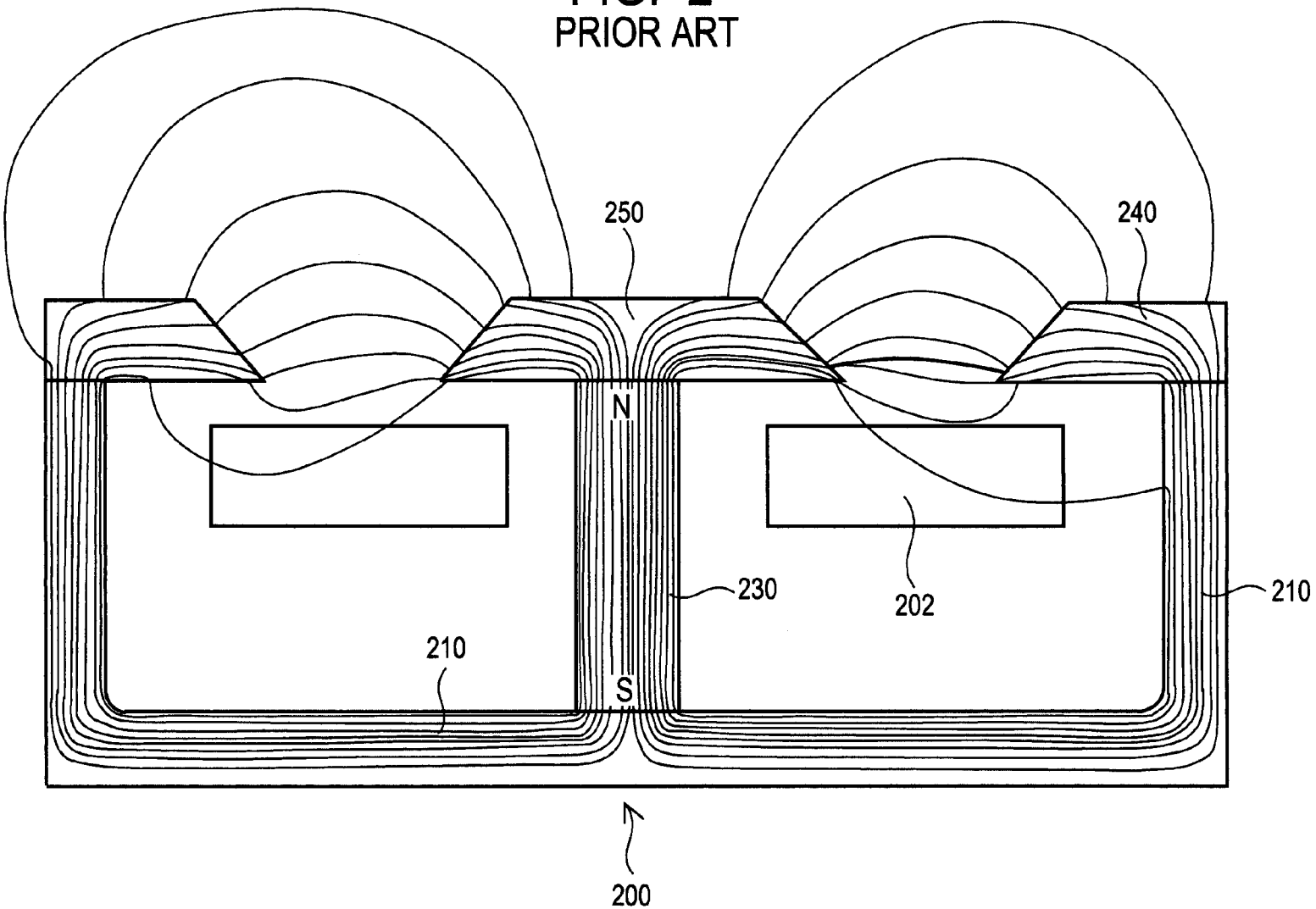
FIG. 2 PRIOR ART
FIG. 2 is a section view of a prior art anode layer ion source.
Figure 2A:
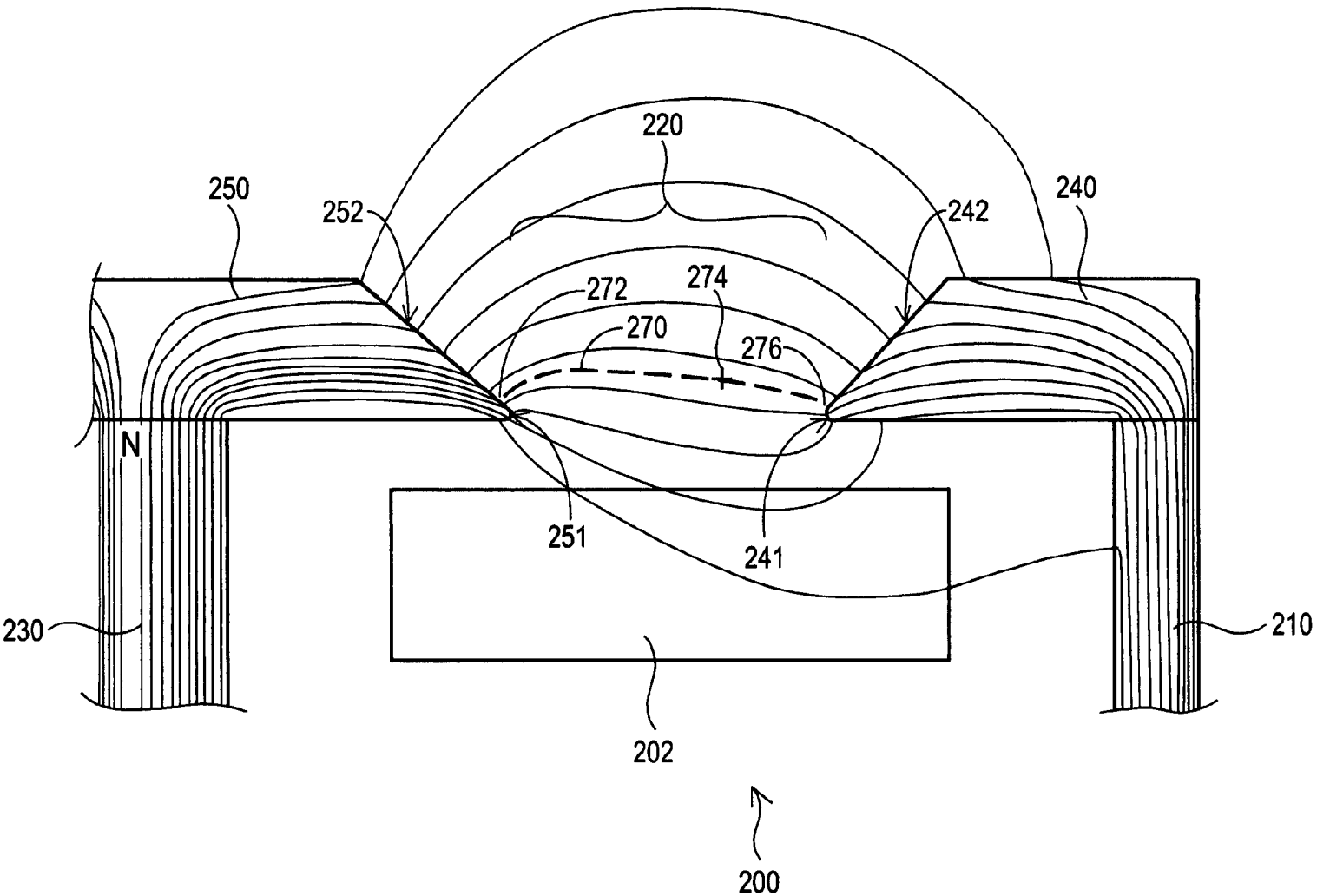
FIG. 2A PRIOR ART
FIG. 2A is a detail view of one gap region of the device of FIG. 2.
Figure 3:
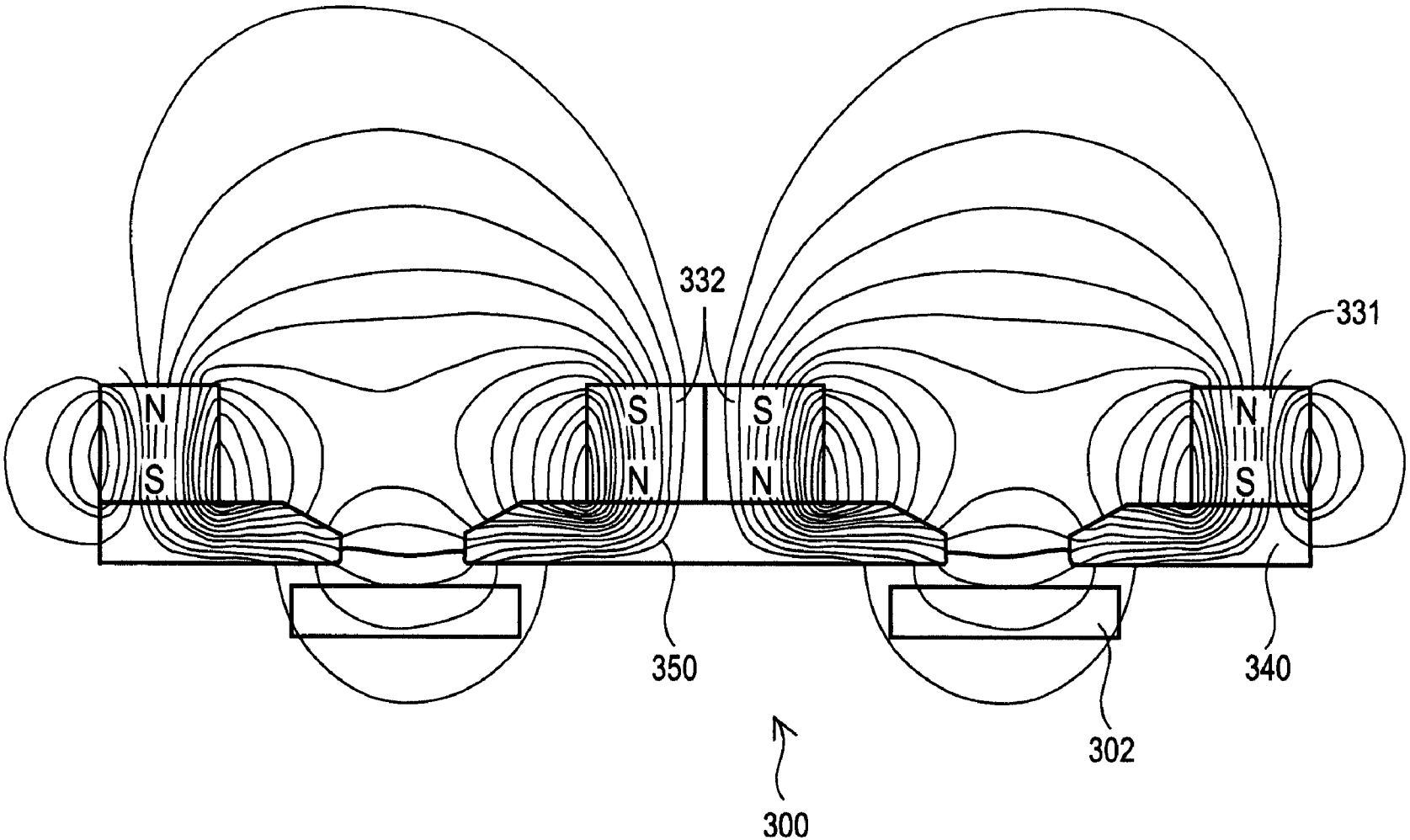
FIG. 3 PRIOR ART
FIG. 3 is a section view of yet another anode layer ion source.
Figure 3A:
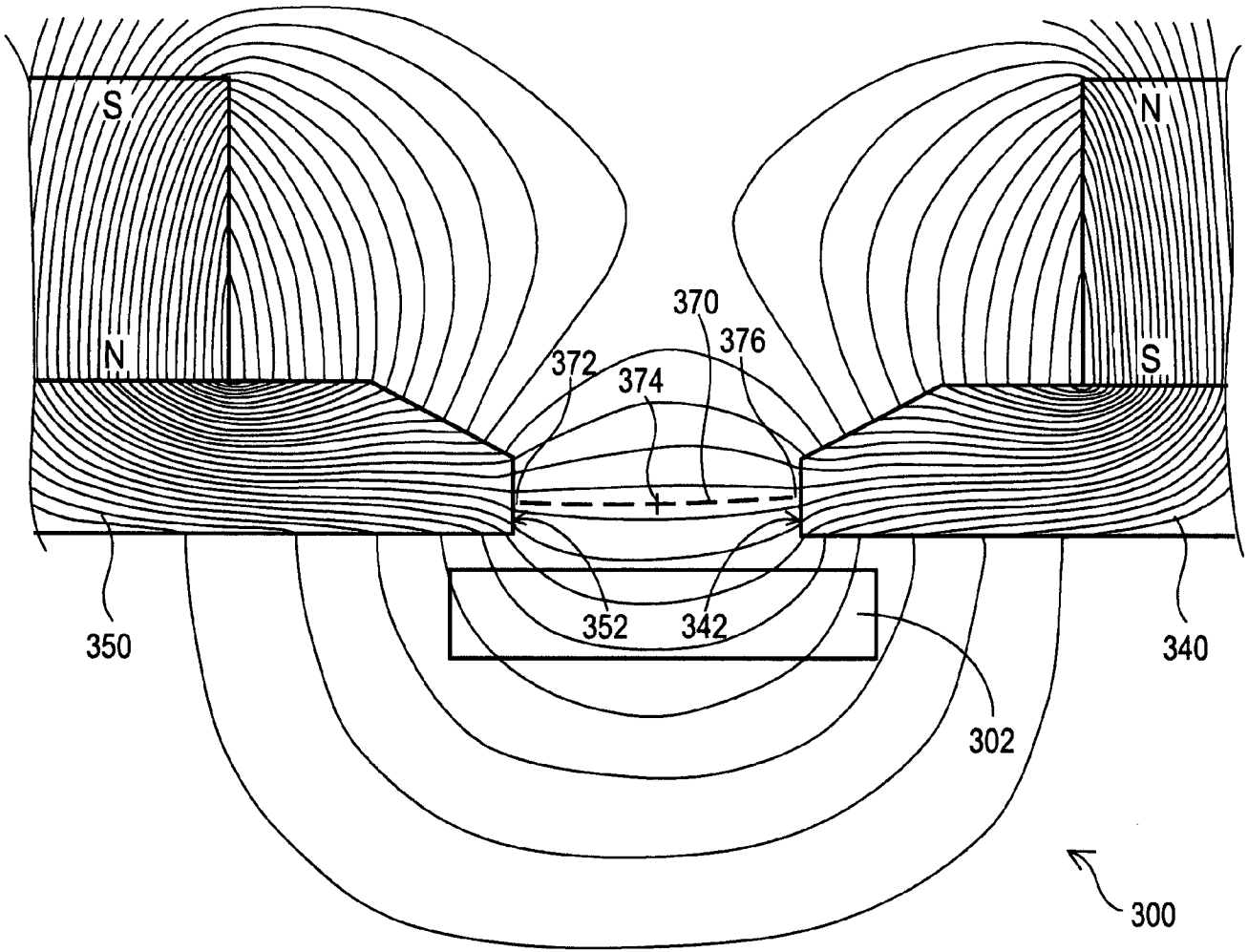
FIG. 3A PRIOR ART
FIG. 3A is a detail view of one gap region of the device of FIG. 3.

Note that the poles 740 and 750 of ion source 700 are shaped with beveled, sloping surfaces on both the internal 744/754 and external 743/753 sides. These bevels taper toward distill ends 742 and 752. By shaping the poles accordingly, the primary field line 770 is readily made to emanate from the pole ends 742 and 752. If the poles are beveled on only one side as shown in FIGS. 3 and 3A, the primary field line does not emanate from the pole ends. Also, by beveling both inner and outer surfaces toward a point, the magnetic field is concentrated toward the point to help create a strong magnetic mirror field. Note that the point can be sharp or include a radius as described earlier.

In order to position anode 702 close to poles 740 and 750 to cut weak mirror magnetic field lines 780, the top surface of anode 702 is raised and includes beveled surfaces 703 and 704. By shaping the anode, anode 702 can be raised up between beveled poles 740 and 750.

Figure 4A:
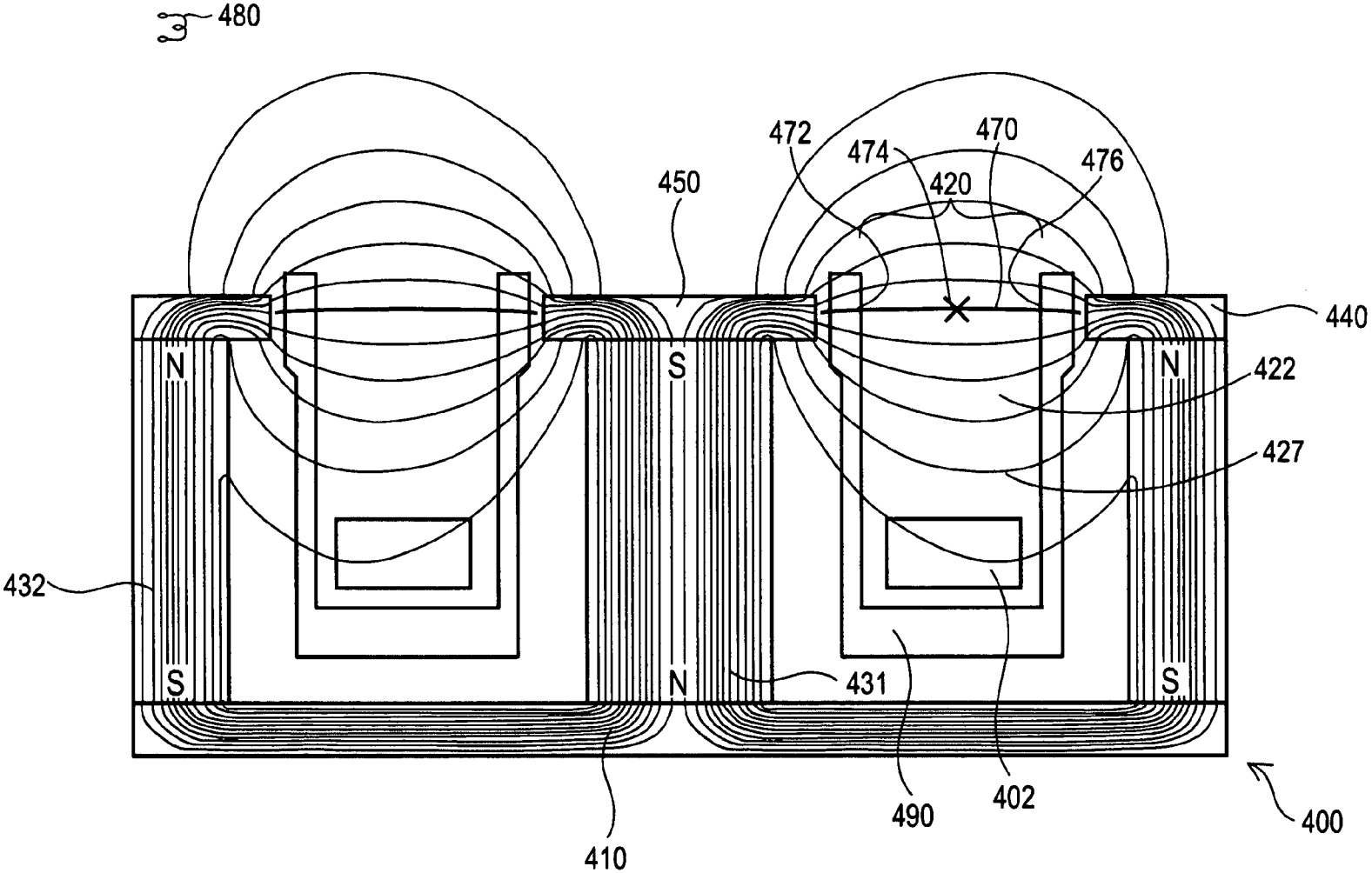
FIG. 4A PRIOR ART
FIG. 4A is a section view of a prior art extended acceleration channel closed drift ion source.
Figure 4B:
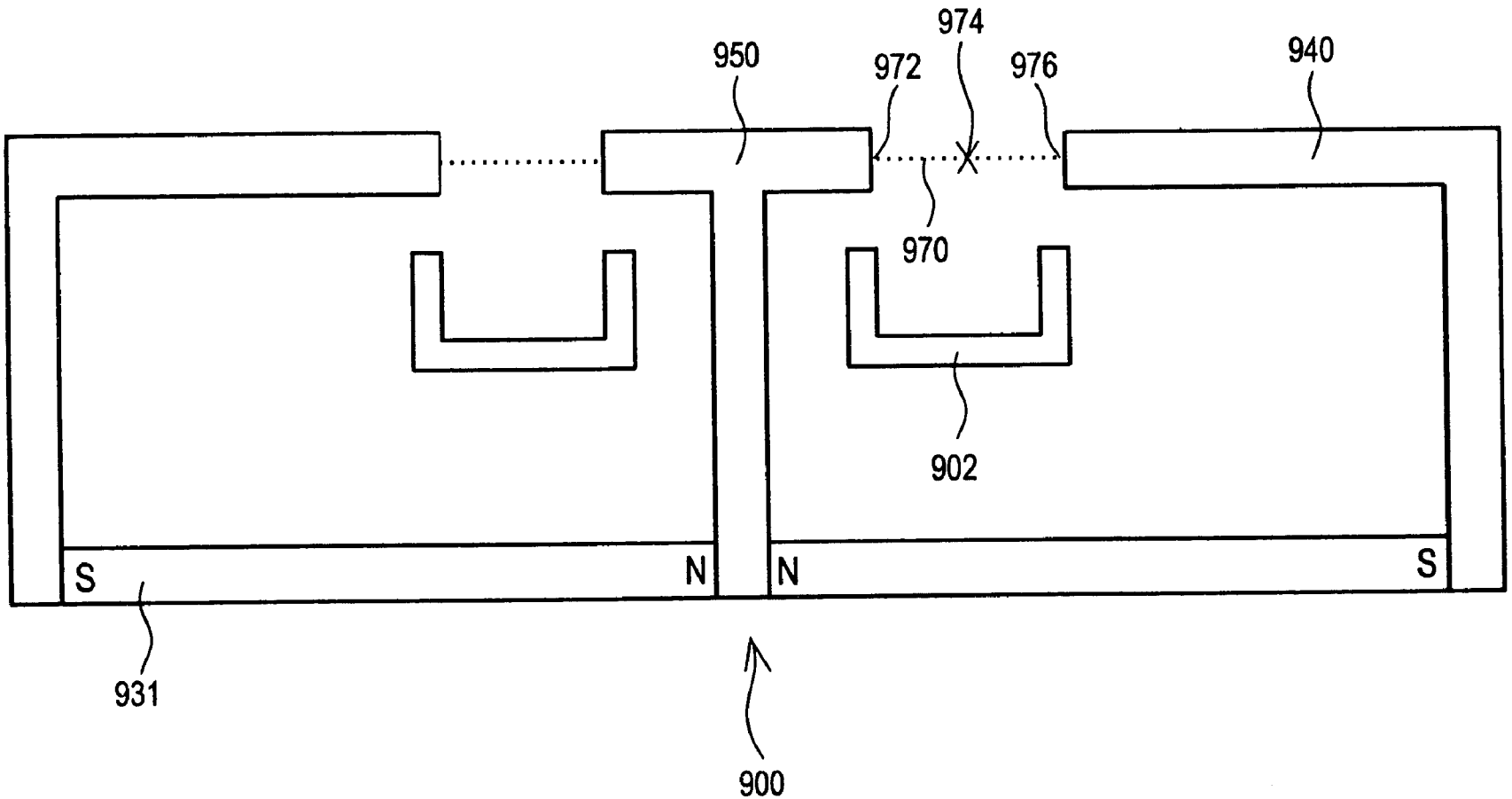
FIG. 4B PRIOR ART
FIG. 4B is a section view of the source in U.S. Pat. No. 5,763,989.

The term beveled is defined as a surface that is not orthogonal to the ion beam line 790. For instance, beveled pole internal 744/754 and external 743/753 surfaces are non orthogonal to the ion beam 790 emanating out of source 700. The term 'internal' is defined as the side of the pole (740/750) facing the anode 702. The term 'external' is defined as the pole surface facing toward the process chamber and substrate. In prior art closed drift ion sources, most often the poles are of a rectangular shape, orthogonal to the beam line as in the prior art sources shown in FIG. 4A and 4B. In some prior art sources (reference FIG. 1, 1A, 2, 2A, 3 and 3A) one surface is flat and orthogonal while the other is beveled. In the Applicants preferred embodiment both the inner and outer pole surfaces include at least one non-orthogonal beveled surface. This beveled, pointed pole structure can be constructed from a single pole piece or other methods such as stacking strips of metal to create a pointed pole. If stacks of ferromagnetic metal strips are used, the bevels will be stepped. While steps of excessive height are not preferred, stepped sloping poles remain within the inventive method. Pointed poles 740 and 750 may also be shaped using a large radius or some other curved shape. In experimentation, a simple radius without pointing the pole is not optimum and does not concentrate the magnetic field as well as a beveled, pointed pole. A compound pointed pole using sloping curves would however perform very well. This is not done due to the increased manufacturing difficulty.

Figure 8:
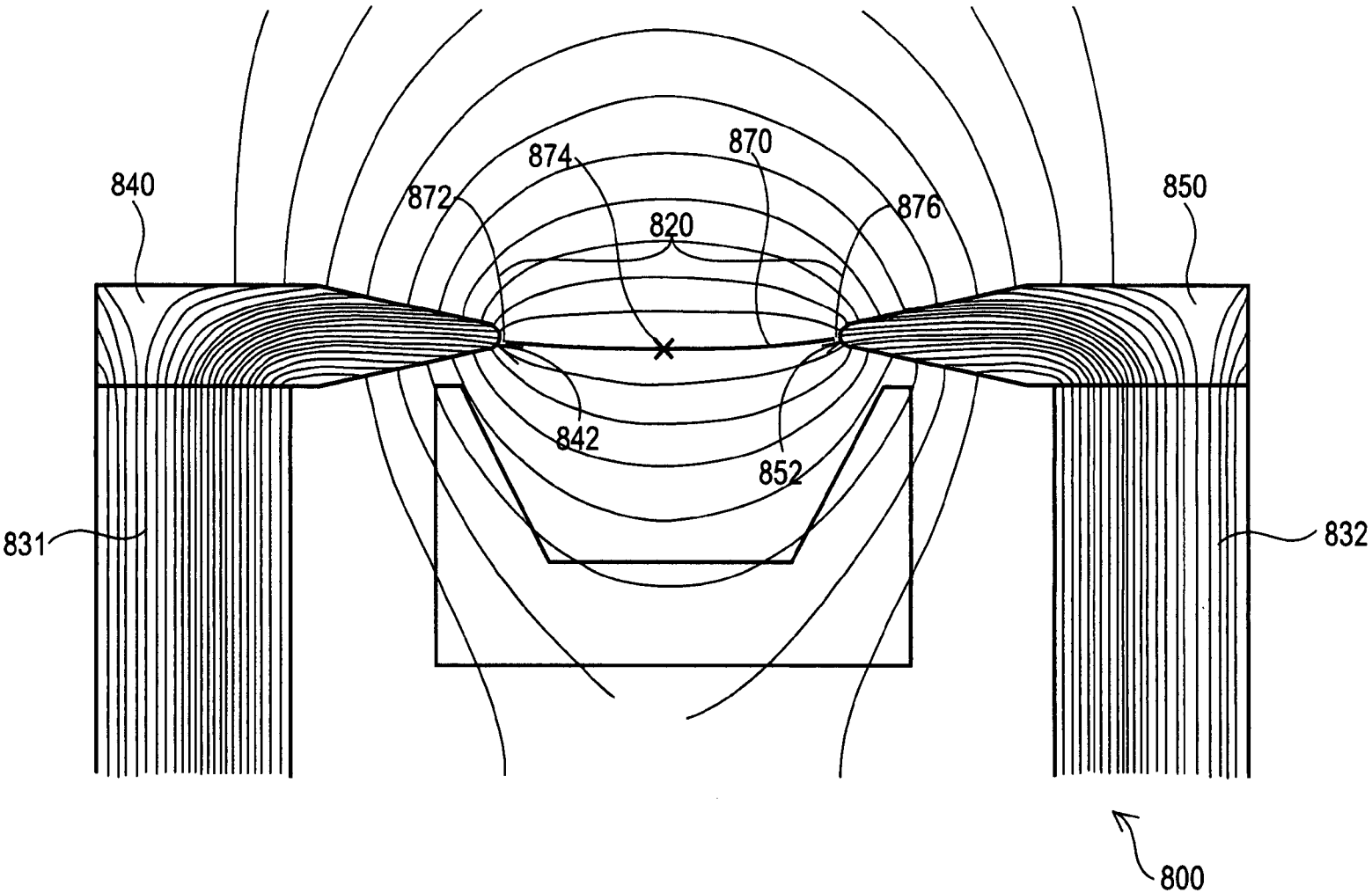
FIG. 8 shows one embodiment of Applicant's closed loop ion source with a wide pointed pole gap.

FIG. 8 shows a detail view of one side of Applicant's closed loop ion source 800 having a wider gap between the magnetic poles. Analysis of the field strengths existing in device 800 shows that by widening the gap, the minimum magnetic mirror field ratio along the primary field line is increased. Primary field line 870 has a strength of 3535 Gauss at first end 872 disposed on surface 842, a strength of 3535 Gauss at second end 876 disposed on surface 852, and a minimum field strength of 685 Gauss at location 874.

Location 874 is substantially equidistant between surface 842 and surface 852. The minimum mirror field ratio of primary field line 870 is greater than 5:1. Primary field strength line 870 has an end-to-end ratio of 1 showing a symmetrical mirror field.

Formula (1) expresses the fraction, in percent, of trapped electrons to the mirror field ratio.

$$\text{Fraction } (\%)=(1-(B_{min}/B_{max}))^{1/2} \quad (1)$$

Using device 800 with a mirror ratio of 5:1, the fraction of trapped electrons is about 89%.

Figure 9:
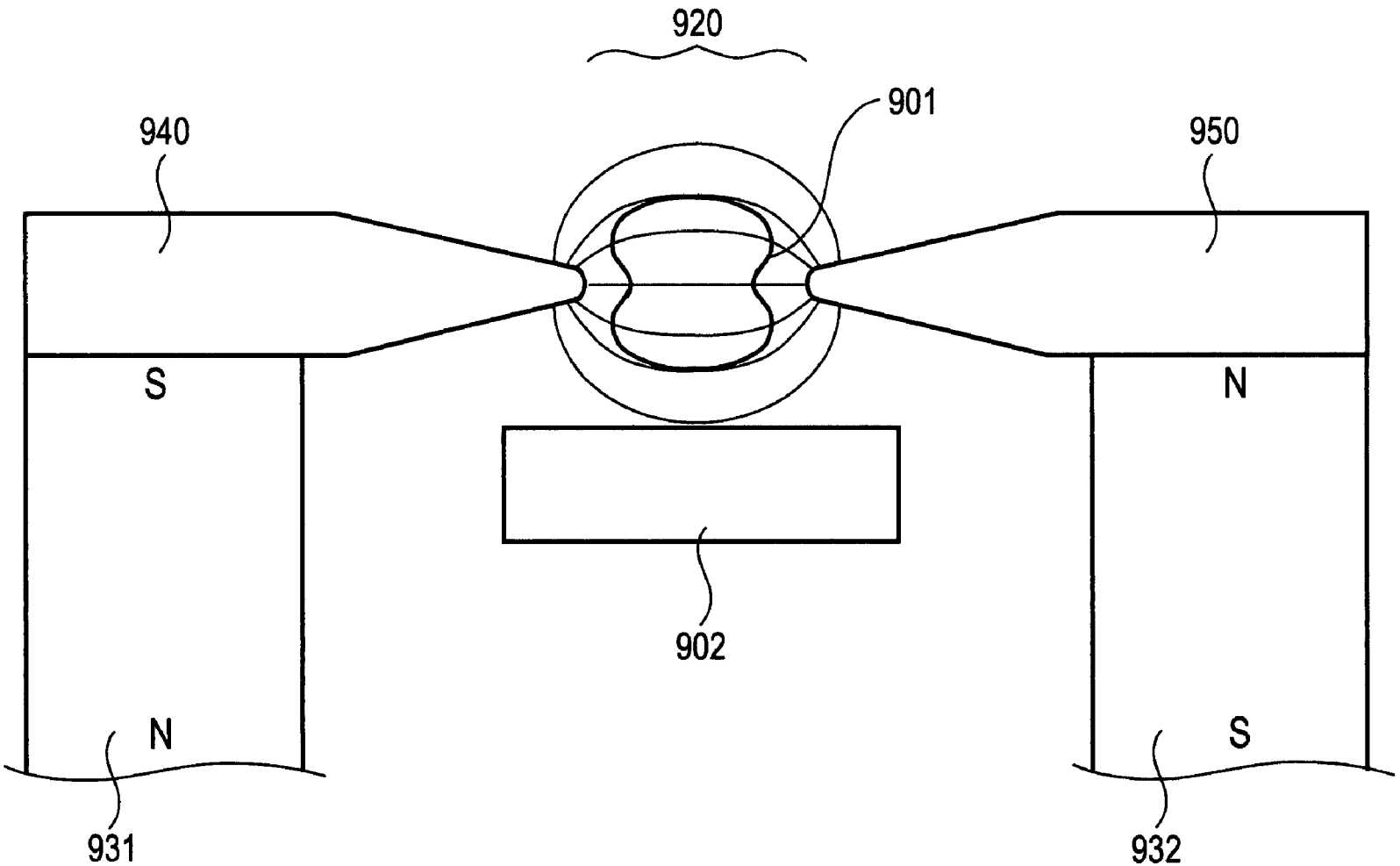
FIG. 9 shows plasma containment using Applicant's ion source.

FIG. 9 diagrams another aspect of plasma containment relating to the inventive method. In this view, a conductive plasma 901 is shown in the gap 920. The point of note is that while the plasma 901 is conductive, all regions of the plasma are not equally conductive. This is due to the changing magnetic fields within the plasma. Axially, the plasma "current" impedance is greater in the central region where the magnetic field is greatest. The larger impedance is due to the smaller gyro-radius in this region and the reduced electron mobility. Radially, with a strong magnetic mirror field achieved by the preferred pointed pole embodiment, the impedance of the plasma is greater closer to the poles. Changes in impedance, like current in a wire, results in associated voltage drops and therefore, while the plasma may be considered conductive, the voltage within the plasma varies. For instance, at the poles, since the impedance due to the mirror magnetic field is higher for electrons, fewer electrons will "flow" toward the poles. This leads to electron depletion near the pole and a more positive voltage near the pole within the plasma. The voltage reaches a steady state when enough electrons are attracted to region to balance the positive bias. The result is beneficial to ion source efficiency. The more positive voltage near the poles causes ions to be repelled back toward the center of the plasma. Axially, a similar effect is at work that produces a higher voltage in the center with the peak voltage at the magnetic field primary line. Here, the higher voltage pushes ions out of the central region. The combined effect is to produce a gradient field toward regions of lower magnetic field strength. With a strong magnetic mirror field present in the gap, this produces a beneficial focusing effect out of the source.

Applicant's ion sources, reduce the rate of erosion of the acceleration channel and/or pole surface material. As a result, several benefits are realized. For example, the life of the source is extended, less heat is generated in the source, the source is made more efficient, and less sputtered, contaminating material is ejected from the source. In addition, Applicant's ion sources collimate the ion beam exiting the source to produce a more focused, useful energy beam.

Applicant's ion sources reduce the wall losses of energetic electrons, particularly those capable of ionizing the source fuel. This further increases the efficiency of the source and reduces source heating. In addition, Applicant's ion sources improve the operation of extended acceleration channel ion sources and space based ion thrusters.

Applicant's ion sources further improve the operation of short acceleration channel sources termed anode layer sources, and improve the operation of anode layer type sources operated as plasma sources in the diffuse high current, low voltage mode.

While the preferred embodiments of the present invention have been illustrated in detail, it should be apparent that modifications and adaptations to those embodiments may occur to one skilled in the art without departing from the scope of the present invention as set forth in the following claims.

I claim:

1. A closed drift ion source for generating an accelerated ion beam comprising:

a closed loop discharge region configured to receive ionizable gas;

an anode located at one longitudinal end of said region, the other end of said region open to allow ion flow out of said discharge region;

a first magnetic pole located radially inward from said region;

a second magnetic pole located radially outward of said region;

a magnetic mirror field in the discharge region wherein said magnetic mirror field is created by said magnetic poles, and wherein said magnetic mirror field comprises a primary magnetic field line between said magnetic poles;

wherein said mirror field is centered on the primary magnetic field line, and wherein said magnetic mirror field has a minimum ratio greater than 2.

2. The closed drift ion source of claim 1, wherein said mirror field is substantially symmetric.

3. The closed drift ion source of claim 1, further comprising:

an electric circuit, wherein the first and second magnetic poles serve as the cathode electrode of the electrical circuit.

4. The closed drift ion source of claim 1, wherein the first and second magnetic poles are not part of the electrical circuit and are electrically isolated.

5. The closed drift ion source of claim 1, wherein the magnetic mirror field has a minimum ratio of greater than 4.

6. The closed drift ion source of claim 1, wherein said magnetic poles are shaped to magnify said magnetic field, and wherein the magnetic field at the surface of the pole structure at the discharge region exceeds the strength of the magnetic source field.

7. A closed drift ion source for generating an accelerated ion beam comprising:

a closed loop discharge region configured to received ionizable gas;

an anode located at one longitudinal end of said region, the other end of said region open to allow ion flow out of said discharge region;

a first magnetic pole having internal and external pole surfaces, said first magnetic pole located radially inward from said region;

a second magnetic pole having internal and external pole surfaces, said second magnetic pole located radially outward of said region;

wherein said poles are shaped to a point including bevels on both internal and external pole surfaces.

8. The closed drift ion source of claim 7, wherein said pointed pole bevels comprise a stepped structure.

9. The closed drift ion source of claim 7, wherein said pointed pole bevels include curved shapes.

10. The closed drift ion source of claim 7, wherein at least a portion of said anode is located between said beveled poles.

* * * * *